US010270213B2

(12) United States Patent
Vasquez et al.

(10) Patent No.: US 10,270,213 B2
(45) **Date of Patent: *Apr. 23, 2019**

(54) CONFIGURABLE LOW PROFILE CONDUIT CONNECTOR SYSTEM FOR LIGHT FIXTURES

(71) Applicant: Eaton Intelligent Power Limited, Dublin (IE)

(72) Inventors: Charles Richard Vasquez, Peachtree City, GA (US); Jonathan Allin Low, Lagrange, GA (US); Jyoti Gururaj Kathawate, Smyrna, GA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/043,024

(22) Filed: Jul. 23, 2018

(65) Prior Publication Data

US 2018/0331476 A1 Nov. 15, 2018

Related U.S. Application Data

(63) Continuation of application No. 15/134,271, filed on Apr. 20, 2016, now Pat. No. 10,033,142.

(51) Int. Cl.
*H01R 13/04* (2006.01)
*H01R 13/73* (2006.01)
(Continued)

(52) U.S. Cl.
CPC ..... *H01R 13/73* (2013.01); *F21S 8/026* (2013.01); *F21V 23/06* (2013.01); *H01R 13/512* (2013.01);
(Continued)

(58) Field of Classification Search
CPC ... H01R 13/567; H01R 13/5841; H01R 24/28
(Continued)

(56) References Cited

U.S. PATENT DOCUMENTS 3,787,798 A 1/1974 Carissimi
4,386,820 A 6/1983 Dola
(Continued)

OTHER PUBLICATIONS

HiseNook 5 Kit, posted at Amazon.com, posted on Nov. 23, 2014, [online], [site visited Apr. 5, 2017]. Available from internet, https://www.amazon.com/HiseNook-Waterproof-Electrical-Connector-Package/dp/BOOMZVYB30 (cited in U.S. Appl. No. 29/561,887).
(Continued)

*Primary Examiner* — Phuong K Dinh
(74) *Attorney, Agent, or Firm* — King & Spalding LLP

(57) ABSTRACT

A connector system that is configured for deployment in a cramped space, e.g., a shallow overhead plenum. The connector system includes a conduit connector that is configured to connect to a light module to provide electrical power to the light module. The conduit connector includes a housing assembly that receives and retains an electrical wire carrying conduit on one end and houses one or more wire connectors on an opposite end. In particular, the one or more wire connectors are disposed vertically in the housing assembly such that a portion of the one or more wire connectors projects out from underneath the housing assembly and forms a substantially right angle with the housing assembly and/or the conduit. Further, the connector system includes a locking clip that is coupled to the light module. The locking clip connects the conduit connector to the light module without the use of a tool.

18 Claims, 11 Drawing Sheets

(51) Int. Cl.

| | |
|---|---|
| ***H01R 13/627*** | (2006.01) |
| ***H01R 13/639*** | (2006.01) |
| ***F21S 8/02*** | (2006.01) |
| ***F21V 23/06*** | (2006.01) |
| ***H01R 13/512*** | (2006.01) |
| ***H01R 13/631*** | (2006.01) |

(52) U.S. Cl.
CPC ..... *H01R 13/6275* (2013.01); *H01R 13/631* (2013.01); *H01R 13/639* (2013.01)

(58) Field of Classification Search
USPC ..... 439/694, 682, 357, 358
See application file for complete search history.

(56) References Cited

U.S. PATENT DOCUMENTS

| | | | | |
|---|---|---|---|---|
| 5,380,224 | A | 1/1995 | DiCicco | |
| 5,679,023 | A | 10/1997 | Anderson, Jr. | |
| 6,162,096 | A | 12/2000 | Klaus | |
| D527,345 | S | 8/2006 | Zhang | |
| D537,781 | S | 3/2007 | Tamura | |
| D593,033 | S | 5/2009 | Ogata | |
| D594,414 | S | 6/2009 | Ogata | |
| D645,405 | S | 9/2011 | Huss, Jr. | |
| D674,347 | S | 1/2013 | Shifris | |
| 8,998,633 | B2 | 4/2015 | Lopez | |
| 10,033,142 | B1 * | 7/2018 | Vasquez | H01R 13/73 |
| 2010/0062635 | A1 | 3/2010 | Jones, Jr. | |
| 2010/0197164 | A1 | 8/2010 | Enomoto | |
| 2012/0156918 | A1 | 6/2012 | Tao | |
| 2014/0308843 | A1 | 10/2014 | Zhu | |
| 2014/0322947 | A1 | 10/2014 | Huang | |
| 2015/0017841 | A1 | 1/2015 | Chen | |

OTHER PUBLICATIONS

VCOM VC-POW8ADP, posted at Amazon.com, posted on Dec. 3, 2015, [online], [site visited Apr. 5, 2017]. Available from the internet, https://www.amazon.com/VCOM-VC-POW8ADP-4-Pin-Connector-CE312/dp/BOOGNTTO86 (cited in U.S. Appl. No. 29/561,887).

Power supply information, posted at Playtool.com, posted on Jul. 15, 2008, [online], [site visited Apr. 5, 2017]. Available from internet, https://www.playtool.com/pages/psuconnectors.html#atx12v4 (cited in U.S. Appl. No. 29/561,887).

* cited by examiner

CONFIGURABLE LOW PROFILE CONDUIT CONNECTOR SYSTEM FOR LIGHT FIXTURES

RELATED APPLICATIONS

The present application is a continuation application of and claims priority to U.S. patent application Ser. No. 15/134,271, filed Apr. 20, 2016, and titled "Configurable Low Profile Conduit Connector System For Light Fixtures." The entire content of the foregoing application is hereby incorporated herein by reference.

TECHNICAL FIELD

The present technology relates to lighting systems and more particularly to a conduit connector system for connecting an electrical supply to a light fixture.

BACKGROUND

Installation of conventional light fixtures in cramped spaces is often challenging due to fixture size and awkward electrical connections. With conventional technology, a connection between an electrical supply and a light fixture housing can be unwieldy due to jutting connectors extending beyond available space. For example, sockets or receptacles for receiving wires that provide power supply to the light fixture may be located at a top surface of the light fixture facing upwards. Accordingly, a conduit carrying electrical wires may be positioned either vertically or at a 45 degree angle above the light fixture for easy coupling with the sockets or receptacles located on the top surface of the light fixture. The vertical or angled entry of the conduit above the light fixture may require a larger plenum space for installation of the light fixture.

Further, conventional connector systems that provide electrical power to the light fixtures may not offer a quick connect and disconnect of the electrical supply to the light fixtures. For example, with conventional connection systems, such as stab lock or push-in connectors, a customer may have to use both hands to make a connection, i.e., one hand to hold the socket portion and another hand to push-in/plug the wires into the socket portion. Alternately or in addition, conventional connector systems may require a customer to use tools for connecting an electrical supply to the light fixtures. The above-mentioned approaches to connect an electrical supply to the light fixture may be time consuming, unwieldy, and inconvenient to a customer.

Therefore, in light of the above shortcomings, improved technology for connecting lighting fixtures to electrical supplies is needed. In particular, need exists for a light fixture connection system that is low profile and suited for deployment in a plenum that is shallow or otherwise space-restricted. Further, need exists for a light fixture connection system that is quick-connect or quick-disconnect, and allows tool-less installation. A capability addressing one or more such needs, or some other related deficiency in the art, would support lighting systems in multiple applications and deployment scenarios.

SUMMARY

In one aspect, the present disclosure can relate to a connector system. The connector system includes a conduit connector that is configured to connect to a light module of a light fixture to provide electrical power to the light module.

The conduit connector includes a housing assembly. In particular, the housing assembly is configured to overlappingly receive and retain an end of a conduit at one end of the housing assembly. The conduit may carry electrical wires. Further, the conduit connector includes one or more wire connectors disposed in the housing assembly at an opposite end of the housing assembly such that at least a portion of the one or more wire connectors projects out from the housing assembly and forms a substantially right angle with the housing assembly. The one or more wire connectors are configured to be coupled to the electrical wires carried by the conduit. In addition to the conduit connector, the connector system includes a locking clip that is coupled to the light module and configured to connect the conduit connector to the light module. The locking clip includes two arms with one or more being flexible. The two arms securely retain the housing assembly of the conduit connector when the conduit connector is connected to the light module. Further, the conduit connector is configured to connect to the light module by matingly engaging the portion of the one or more wire connectors that projects out from the housing assembly with respective wire connector receptacles disposed in the light module.

In another aspect, the present disclosure can relate to a conduit connector that includes a housing assembly and one or more wire connectors. The housing assembly is configured to overlappingly receive and retain an end of a conduit at one end of the housing assembly. The conduit carries electrical wires. Further, the one or more wire connectors disposed in the housing assembly at an opposite end of the housing assembly such that at least a portion of the one or more wire connectors projects out from the housing assembly and forms a substantially right angle with the housing assembly. The one or more wire connectors are configured to be coupled to the electrical wires, and the conduit connector is configured to connect to a light module of a light fixture to provide electrical power to the light module.

In yet another aspect, the present disclosure can relate to a connector system. The connector system includes a conduit connector that is configured to connect a conduit to a light module of a light fixture. The conduit connector includes a housing assembly that comprises a top housing and a bottom housing that is coupled to the top housing using one or more fasteners. Each of the top housing and the bottom housing includes a conduit receiving portion that is configured to receive and retain a portion of the conduit. Further each of the top and bottom housing includes a wire connector portion that is configured to house one or more wire connectors in vertical orientation such that a portion of the one or more wire connectors projects out from the housing assembly and forms a substantially right angle with at least one of the housing assembly and the conduit.

These and other aspects, objects, features, and embodiments will be apparent from the following description and the appended claims.

BRIEF DESCRIPTION OF THE DRAWINGS

The foregoing and other features and aspects of the disclosure are best understood with reference to the following description of certain example embodiments, when read in conjunction with the accompanying drawings, wherein.

Figure 1A:
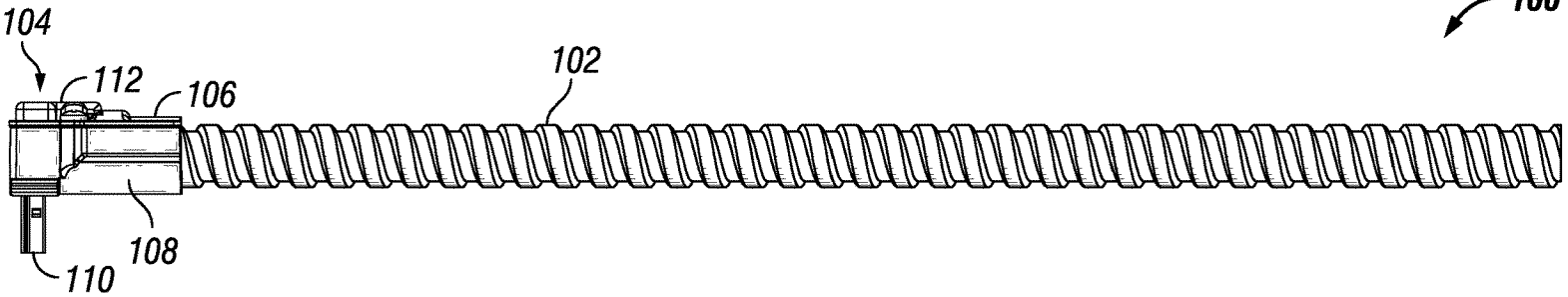
FIGS. 1A and 1B (collectively 'FIG. 1') illustrate a side view and a top view of an example conduit connector, in accordance with an example embodiment of the present disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of the example embodiments. Additionally, certain dimensions or positioning may be exaggerated to help visually convey such principles.

DETAILED DESCRIPTION OF EXAMPLE EMBODIMENTS

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure is directed to a low-profile conduit connector system (herein "connector system") for providing electrical power supply to a light fixture. The connector system includes a conduit connector. In particular, the conduit connector includes a housing that is divided into a wire connector portion and a conduit receiving portion. The conduit receiving portion of the housing overlappingly receives and securely retains an end of a conduit such that the conduit terminates in the housing. The opposite end of the conduit may be connected to an external power supply source or a junction box, and the conduit may carry electrical power supply wires (herein "electrical wires") from the external power supply source or junction box to the housing. Further, the wire connector portion of the housing accommodates one or more wire connectors such that a portion of the one or more wire connectors projects out from underneath the housing forming a substantially right angle with the housing and/or the conduit. The one or more wire connectors are coupled to the electrical wires that are carried by the conduit and enter the housing via the conduit.

Furthermore, the connector system may include a light fixture part that is positioned on a light module of the light fixture and includes one or more wire connector receptacles and/or a locking clip. In particular, the one or more wire connector receptacles are disposed within a housing assembly of the light module such that they face an upward direction and a top end of the one or more wire connector receptacles is flush with an opening on a top surface of the light module. The locking clip is disposed on and coupled to the top surface of the light module such that an opening of the locking clip axially aligns with the opening on the top surface of the light module that is flush with the top end of the one or more wire connector receptacles. In other words, the opening of the locking clip exposes the top end of the one or more wire connector receptacles. In addition to the opening, the locking clip has two arms that are disposed on opposite sides of the opening. One or more of the arms are flexible such that they bend away from each other when a pressure is applied and they return back to a default position (closer to each other) when the pressure is released.

The conduit connector is adapted to be connected to the light module to provide electrical power to a light source in the light module. In particular, the one or more wire connectors of the conduit connector and the one or more wire connector receptacles of the light module are designed to operate as a plug-and-socket assembly. That is, the portion of the one or more wire connectors that extends out from underneath the housing of the conduit connector matingly engages the corresponding one or more wire connector receptacles of the light module to provide electrical power from the external power source/junction box to the light source in the light module. Specifically, the one or more wire connectors of the conduit connector enter the corresponding one or more wire connector receptacles of the light module through the top end of the one or more wire connector receptacles exposed by the opening of the locking clip. Even though the wire connectors enter the wire connector receptacles from a top surface of the light module, the substantially right angle alignment of the wire connectors with the housing of the conduit connector allows the conduit to approach the light module horizontally for coupling with the light module, rather than having to approach from vertically above the light module as in conventional light fixtures. That is, the connector system of the present disclosure allows the conduit to be horizontally oriented in a plenum space when the conduit connector is connected to light module at a top surface of the light module, thus, resulting in a low profile. This ability to couple a horizontally oriented conduit to the light module allows for installation of the light fixture in a plenum space that is shallow.

Further, the conduit connector is coupled to and locked in position with the light module by the locking clip. For example, to connect the conduit connector to the light module, a customer applies pressure (either using fingers or using the housing of the conduit connector) on the two arms of the locking clip to push them away from each other. Then, the customer inserts the conduit connector in between the arms of the locking clip. Further, the one or more wire connectors of the conduit connector is inserted into the corresponding one or more wire connector receptacles in the light module. In particular, the wire connectors are inserted into the wire connector receptacles from the top end of the wire connector receptacles that is exposed through the axially aligned openings of the locking clip and the top surface of the light module. Once the wire connectors in the conduit connector are inserted into the wire connector receptacles in the light module, the customer releases the pressure on the two arms of the locking clip causing the two arms spring back inward, i.e., towards each other. Alternatively, if the user does not push the arms of the locking clip apart and simply pushes the conduit connector into the locking clip, the arms of the locking clip are biased inward against the conduit connector. When the arms of the locking clip are biased inward, they clamp the housing of the conduit connector disposed in between the arms and lock the conduit connector in position. All of the above-mentioned operations to connect the conduit connector to the light module can be done by the customer using one hand. Accordingly, the locking clip facilitates a one-handed and tool-less quick connect and/or disconnect of the conduit connector with the light module.

Furthermore, the connector system is configurable to accommodate more than one wire connector by adapting the design of the housing of the conduit connector and the opening of the locking clip. For example, the connector system is configurable to accommodate two wire connectors, four wire connectors, six wire connectors, or more based on the application for which the connector system is used and the amount of electrical power needed for the respective application. In some embodiments, an odd number of wire connectors may also be used. Furthermore, the housing of the conduit connector is also configurable to accommodate conduits of different sizes, shapes, and material.

The technology of the present disclosure can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "example embodiments" given herein are intended to be non-limiting and among others supported by representations of the present technology.

A connector system for light fixtures will now be described in more detail in association with FIGS. 1-15. In particular, first, a two wire connector system (interchangeably referred to as a 'two-pin connector system') will be described by making reference to FIGS. 1-9. Then, a four wire connector system (interchangeably referred to as a 'four-pin connector system') will be described by making reference to FIGS. 10-15.

Two Wire Connector System

Figure 1B:
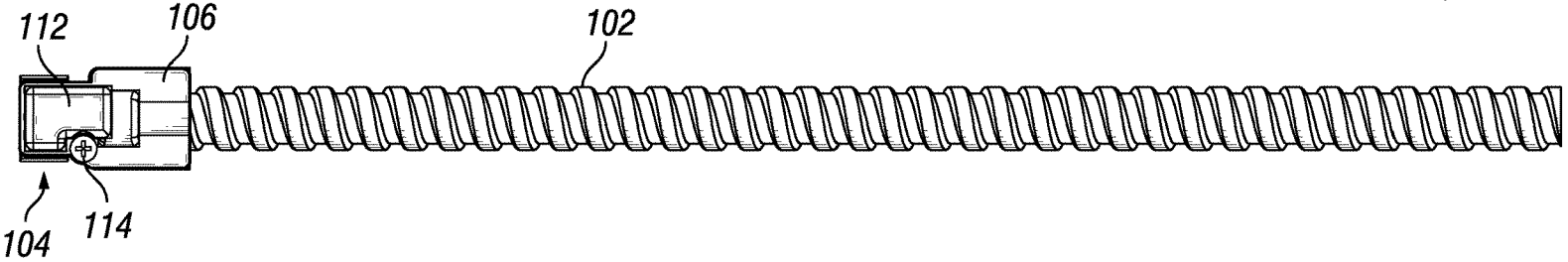
Figure 2:
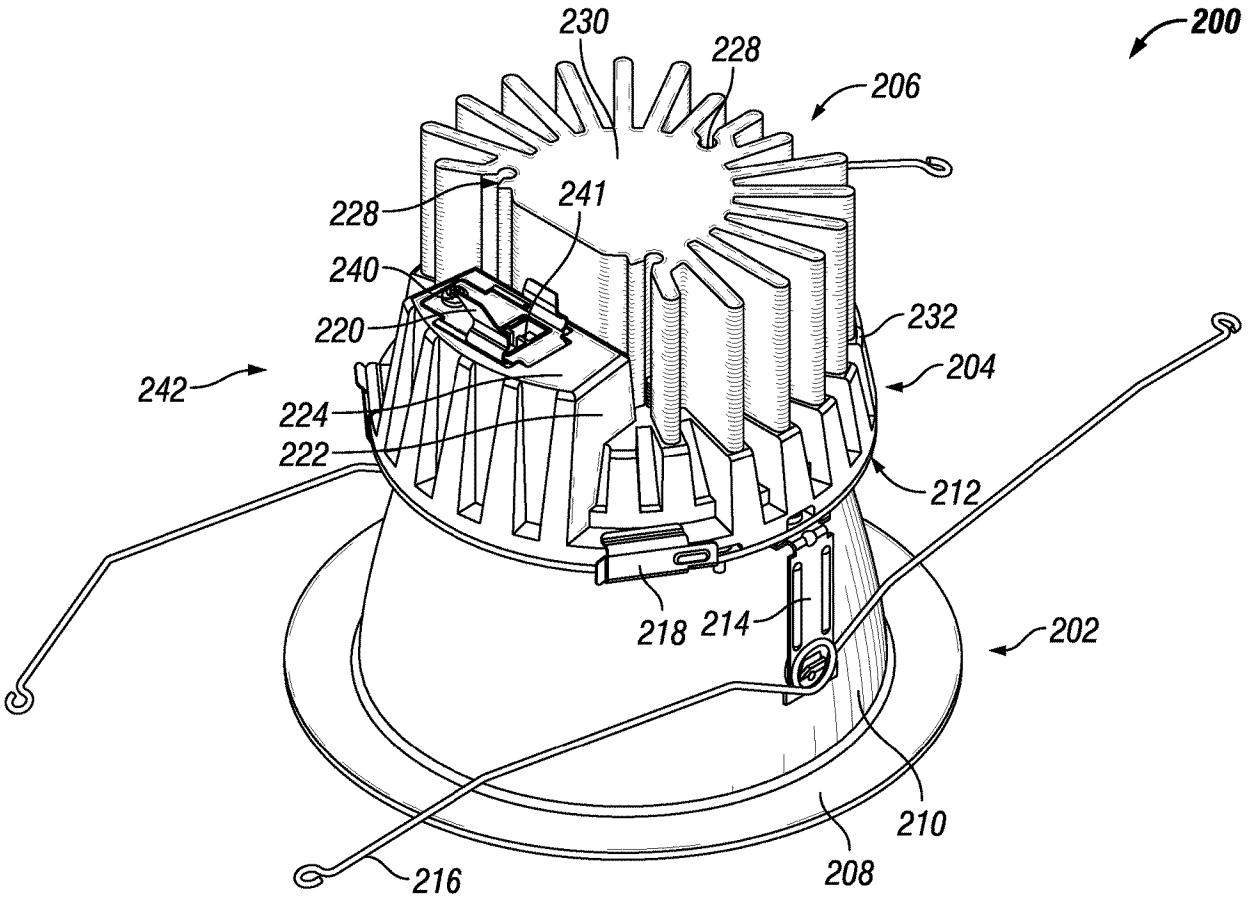
FIG. 2 illustrates a perspective view of an example light fixture that houses a wire connector receptacle and an example locking clip coupled to the example light fixture, in accordance with an example embodiment of the present disclosure.
Figure 3:
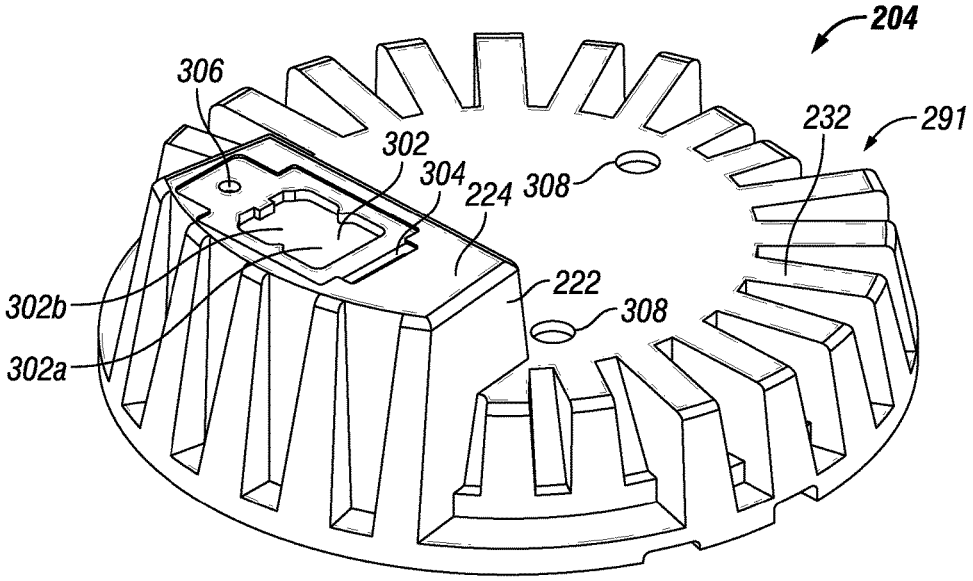
FIG. 3 illustrates an enlarged view of the outer housing of the example light fixture of FIG. 2, in accordance with an example embodiment of the present disclosure.
Figure 4:
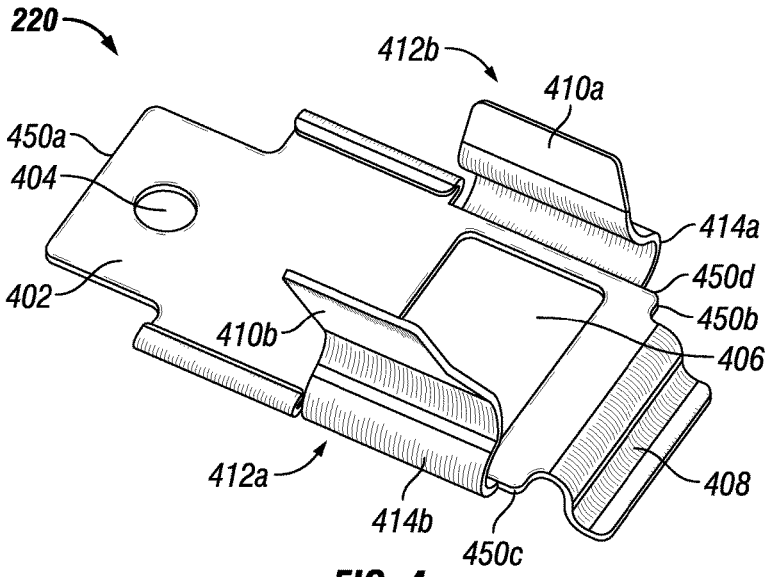
FIG. 4 illustrates the example locking clip of FIG. 2 that allows quick connect and disconnect of the example conduit connector of FIG. 1 to the example light fixture of FIG. 2, in accordance with an example embodiment of the present disclosure.
Figure 5B:
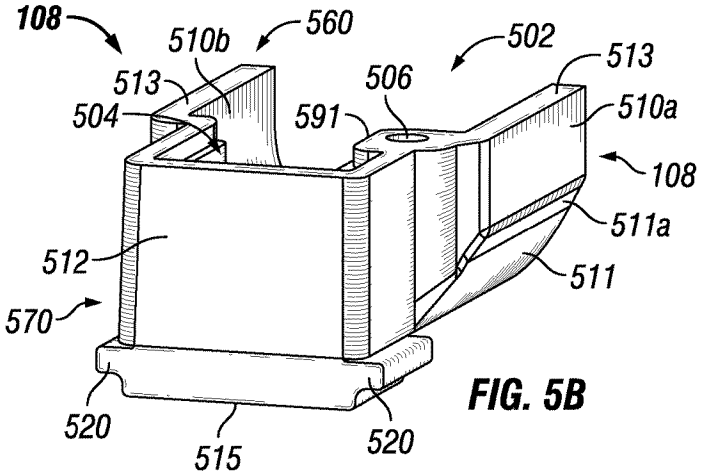
FIGS. 5A and 5B (collectively 'FIG. 5') illustrate different views of a bottom housing of the example conduit connector of FIG. 1, in accordance with an example embodiment of the present disclosure.
Figure 7:
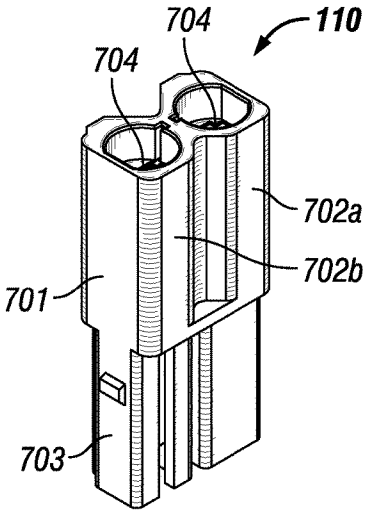
FIG. 7 illustrates a perspective view of an example two-wire connector disposed in the example conduit connector of FIG. 1, in accordance with an example embodiment of the present disclosure.
Figure 5A:
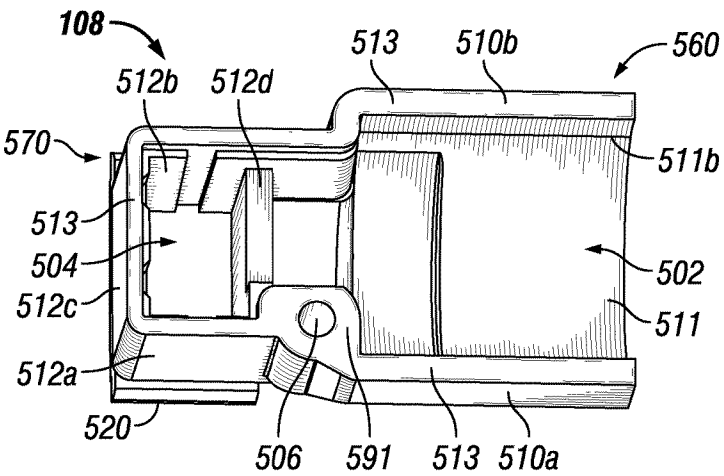
Figure 6:
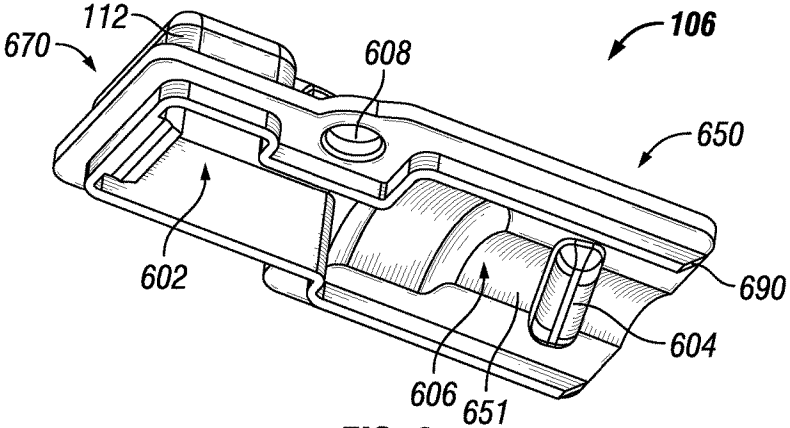
FIG. 6 illustrates a perspective view of a top housing of the conduit connector of FIG. 1, in accordance with an example embodiment of the present disclosure.
Figure 8:
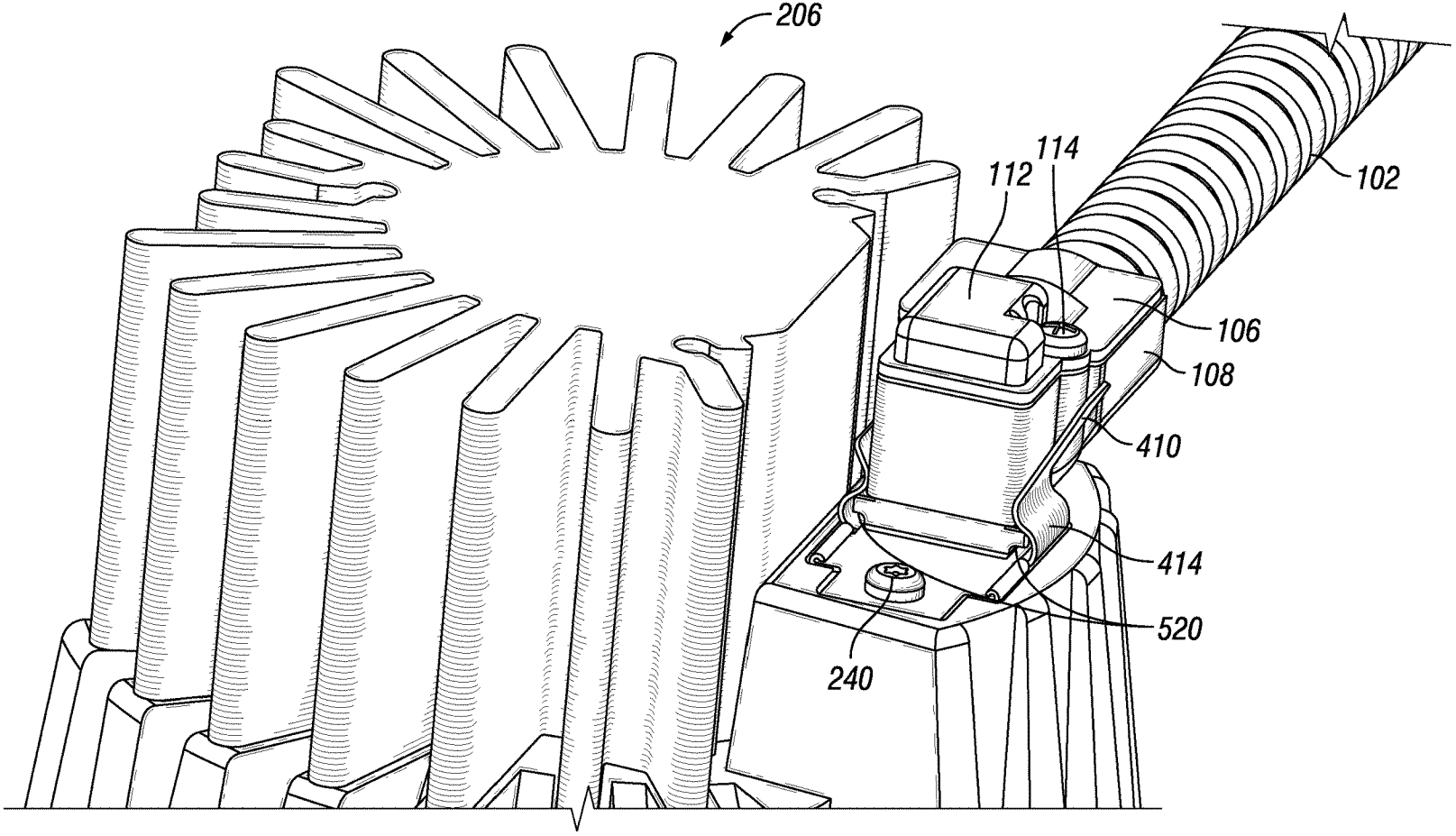
FIG. 8 illustrates the example conduit connector of FIG. 1 connected to the example light fixture of FIG. 2 using the example locking clip of FIG. 2, in accordance with an example embodiment of the present disclosure.
Figure 9:
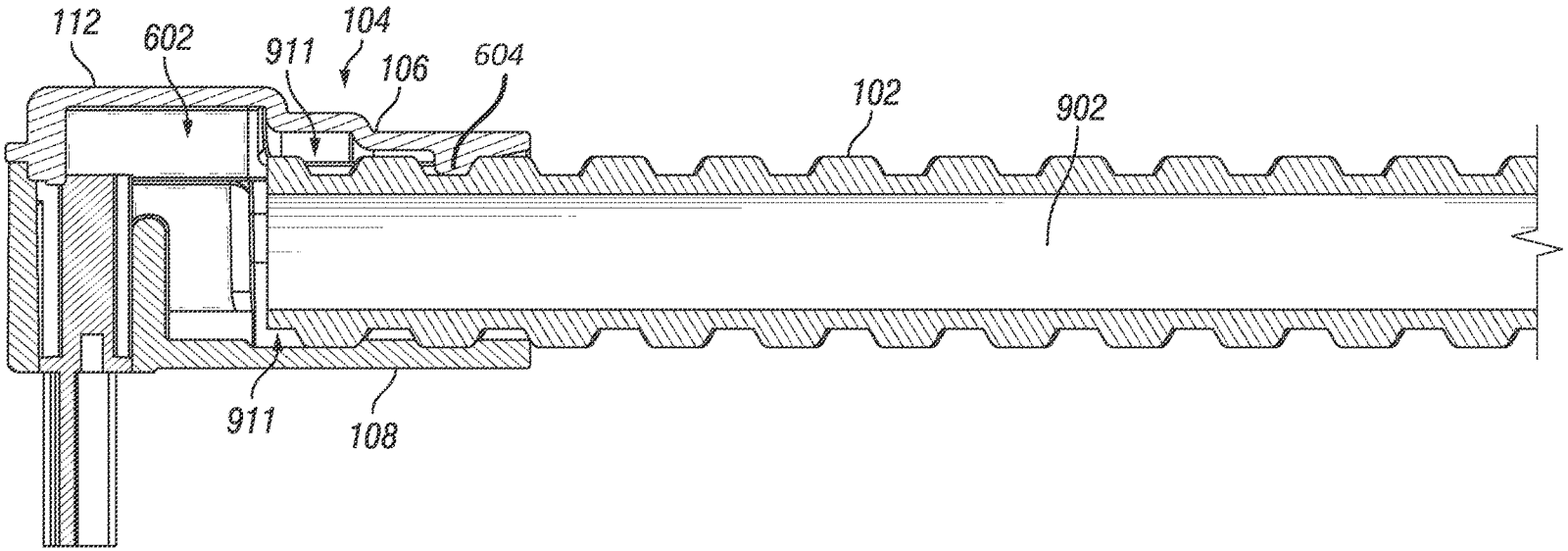
FIG. 9 illustrates a cross-sectional view of the example conduit connector of FIG. 1, in accordance with an example embodiment of the present disclosure.

FIGS. 1A and 1B (collectively 'FIG. 1') illustrate a side view and a top view of an example conduit connector, in accordance with an example embodiment of the present disclosure; FIG. 2 illustrates a perspective view of an example light fixture that houses a wire connector receptacle and an example locking clip coupled to the example light fixture, in accordance with an example embodiment of the present disclosure; FIG. 3 illustrates an enlarged view of the outer housing of the example light fixture of FIG. 2, in accordance with an example embodiment of the present disclosure; FIG. 4 illustrates the example locking clip of FIG. 2 that allows quick connect and disconnect of the example conduit connector of FIG. 1 to the example light fixture of FIG. 2, in accordance with an example embodiment of the present disclosure; FIGS. 5A and 5B (collectively 'FIG. 5') illustrate different views of a bottom housing of the example conduit connector of FIG. 1, in accordance with an example embodiment of the present disclosure; FIG. 6 illustrates a perspective view of a top housing of the conduit connector of FIG. 1, in accordance with an example embodiment of the present disclosure; FIG. 7 illustrates a perspective view of an example two-wire connector disposed in the example conduit connector of FIG. 1, in accordance with an example embodiment of the present disclosure; FIG. 8 illustrates the example conduit connector of FIG. 1 connected to the example light fixture of FIG. 2 using the example locking clip of FIG. 2, in accordance with an example embodiment of the present disclosure; FIG. 9 illustrates a cross-sectional view of the example conduit connector of FIG. 1, in accordance with an example embodiment of the present disclosure.

Referring to FIGS. 1-9, a two wire connector system may include a conduit connector 100 and/or a light fixture part 242. In particular, the conduit connector 100 includes a mechanical housing assembly 104 that has a top housing 106 and a bottom housing 108 that are coupled to each other using a fastener, e.g., screw 114. As illustrated in FIG. 5, the bottom housing 108 may include a conduit receiving portion 560 disposed at one end and a wire connector portion 570 disposed at an opposite end. Further, the conduit receiving portion 560 and the wire connector portion 570 may be separated by a middle portion that includes a screw boss 591 having a blind aperture 506. The term 'middle portion' as used herein generally refers to a portion that is disposed in between two other portions and not necessarily related to a center or mid-point of a structure.

In certain example embodiments, the conduit receiving portion 560 of the bottom housing 108 may include a substantially semi-cylindrical wall 511, a first side wall 510*a* extending upwards from a longitudinal edge 511*a* of the substantially semi-cylindrical wall 511 to a top edge 513 of the bottom housing 108, and a second side wall 510*b* extending upwards from an opposite longitudinal edge 511*b* of the substantially semi-cylindrical wall 511 to an opposite portion of the top edge 513. The first side wall 510*a* may be parallel to the second side wall 510*b*. Further, as illustrated in FIG. 5A, the substantially semi-cylindrical wall 511 and the two side walls 510*a*, 510*b* of the conduit receiving portion 560 may define a cavity 502 that is configured to receive and retain a bottom portion of the conduit 102.

In certain example embodiments, the wire connector portion 570 of the bottom housing 108 may include a front wall 512*c* that extends from a bottom edge 515 of the bottom housing 108 to a front portion of the top edge 513, and a back wall 512*d* that is opposite to the front wall 512*c*. Further, the wire connector portion 570 of the bottom housing 108 may include a first side wall 512*b* that extends from one side edge of the front wall 512*c* towards the first side wall 510*b* of the conduit receiving portion 510, and a second side wall 512*a* that extends from an opposite side edge of the front wall 512*c* towards the second side wall 510*a* of the conduit receiving portion 560. As illustrated in FIG. 5A, the front wall 512*c*, the back wall 512*d*, and the two side walls 512*a*, 512*b* of the wire connector portion 570 may define a cavity 504 that is open on a top side and a bottom side and is configured to house a two-wire connector 110 shown in FIG. 7.

In particular, the two-wire connector 110 may include a first wire connector 702*a* and a second wire connector 702*b* as illustrated in FIG. 7. In one example embodiment, the first wire connector 702*a* and the second wire connector 702*b* may be integral to each other and may be formed as one member. However, in other example embodiments, the first and second wire connectors 702*a* and 702*b* may be separate or detached from each other. In either case, each wire connector 702*a*/702*b* may include a top portion 701 and a bottom portion 703. Further, each wire connector 702*a*/702*b* may include a wire receiving portion 704 that is configured to receive and retain electric wires. Even though the present disclosure describes a two-wire connector 110, one of ordinary skill in the art can understand and appreciate that in some embodiments a single wire connector may be used. That is, an odd number of wire connectors may be used in the conduit connector without departing from a broader scope of the present disclosure.

Referring to FIGS. 1 and 9, the two-wire connector 110 may be disposed in the cavity 504 defined by the wire connector portion 570 of the bottom housing 108 such that: (a) the top portion 701 of the two-wire connector 110 is concealed by the wire connector portion 570 of the bottom housing 108, and (b) the bottom portion 703 of the two-wire connector 110 projects out from an opening in the bottom side of the bottom housing's wire connector portion 570. In particular, the two-wire connector 110 may be disposed within the cavity 504 in a vertical orientation such that the two-wire connector 110 is substantially perpendicular to the mechanical housing assembly 104 (and/or a conduit 102 received by the housing). Consequently, the bottom portion 703 of the two-wire connector 110 that projects out from the opening in the bottom side of the bottom housing's wire connector portion 570 forms a substantially right angle with the mechanical housing assembly 104.

Referring back to FIG. 5, in addition to the plurality of walls 512*a-d* and cavity 504, the wire connector portion 570 of the bottom housing 108 may include a pair of flanges 520 adjacent a bottom edge 515 of the wire connector portion 570. In particular, each flange 520 may extend outwards in opposite direction from a respective side wall 512*a*, 512*b* of the wire connector portion 570. Further, each flange 520 may be substantially perpendicular to the respective side wall 512*a*/512*b* from which it extends and may be horizontally oriented as illustrated in FIG. 5A.

Referring now to FIG. 6, the top housing 106 of the mechanical housing assembly 104 may include a conduit receiving portion 650 and a wire connector portion 670. The conduit receiving portion 650 and the wire connector portion 670 of the top housing 106 may be separated by a middle portion that includes a coupling aperture 608. As illustrated in FIGS. 1, 6, and 8, the conduit receiving portion 650 of the top housing 106 may include a substantially curved top surface 651 having a convex outer profile and a concave inner profile. In particular, the substantially curved top surface 651 of the top housing's conduit receiving portion 650 may define a cavity 606 that is configured to receive and retain a top portion of the conduit 102. In certain example embodiments, the curved top surface 651 of the top housing 106 may determine the type and size of the conduit 102 that can be accommodated by the mechanical housing assembly 104. For example, different top housings may be used to accommodate conduits of different sizes, such as 5/16" and 3/8 trade size conduit as well as Flexible Metal Tubing.

In addition to the curved top surface 651, the conduit receiving portion 650 of the top housing 106 may include a relief rib 604 that is configured to bias against a contoured/ribbed surface of the conduit 102 to securely lock or retain the conduit 102 within the mechanical housing assembly 104 and prevent the conduit 102 from being pulled out once it is coupled to the mechanical housing assembly 104.

Further, as illustrated in FIG. 6, the wire connector portion 670 of the top housing 106 may include a raised top surface 112 that defines a cavity 602. In particular, the cavity 602 provides space for routing the electrical wires from the conduit 102 to the wire connectors disposed in the mechanical housing assembly 104. Additionally, the top housing 106 may include a sealing wall 690 that spans the conduit receiving portion 650 and the wire connector portion 670, where the perimeter of the sealing wall 690 is shaped substantially similar to a profile of the top edge 513 of the bottom housing 108. In particular, when the top housing 106 is coupled to the bottom housing 108, the sealing wall 690 may bias an inner surface of the bottom housing 108 adjacent the top edge 513 to seal any gaps between the top housing 106 and the bottom housing 108.

As illustrated in FIGS. 1, 8, and 9, the top housing 106 may be coupled to the bottom housing 108 to form the mechanical housing assembly 104. In certain example embodiments, to couple the top housing 106 to the bottom housing 108, the top housing 106 may be placed on top of the bottom housing 108 such that: (a) the coupling aperture 608 of the top housing 106 is axially aligned with the blind aperture 506 of the bottom housing 108, (b) the wire connector portion 670 of the top housing 106 is aligned with the wire connector portion 570 of the bottom housing 108, and (c) the conduit receiving portion 650 of the top housing 106 is aligned with the conduit receiving portion 560 of the bottom housing 108. Then, a fastener may be passed through the axially aligned coupling aperture 608 of the top housing 106 and the blind aperture 506 of the bottom housing 108. However, in other example embodiments, any other appropriate coupling mechanisms may be used to couple the top housing 106 to the bottom housing 108 without departing from a broader scope of the present disclosure.

As illustrated in FIG. 9, when the top housing 106 is coupled to the bottom housing 108 to form the mechanical housing assembly 104, the cavities 606 and 502 formed by the top housing's conduit receiving portion 650 and the bottom housing's conduit receiving portion 560, respectively, may combine to form a substantially cylindrical cavity 911 that is configured to overlappingly receive an end of the conduit 102 such that the conduit 102 terminates within the cylindrical cavity 911 of the mechanical housing assembly 104. Further, as described above, the relief rib 604 of the top housing's conduit receiving portion 650 may securely lock (pressure fit) the conduit 102 in place by biasing a ribbed/contoured surface of the conduit 102. In other words, the conduit 102 is clamped in place by coupling the top housing 106 to the bottom housing 108.

In particular, the conduit 102 houses and carries electrical lines from a power supply source to the mechanical housing assembly 104. The conduit 130 is typically flexible, for example metallic interlock conduit, with the metallic composition providing electrical conductivity for an electrical ground. That is, ground current, if present, may flow along the conduit 130 via the conduit's metal composition. Other embodiments may utilize other conduits or tubes for housing electrical lines. Such conduits may be rigid in some embodiments and flexible in other embodiments and may be either conductive or nonconductive. A conduit composed of electrically insulating material may carry a dedicated ground wire in addition to wires forming an electrical supply circuit, for example.

In certain example embodiments, the electrical wires that enter the mechanical housing assembly 104 via the conduit 102 may be routed to the two-wire connector 110 through the middle portion and the cavity 602 formed by the wire connector portion 670 of the top housing 106. In other words, the mechanical housing assembly 104 provides a concealed pathway for the electrical wires from the power supply source to the two-wire connectors 110. In particular, the electrical wires may enter the mechanical housing assembly 104 through the end of the conduit 102 that is overlappingly retained by the mechanical housing assembly 104. Further, the electrical wires may be routed into the cavity 602 formed above the two-wire connector 110, bent downwards towards the two-wire connector 110, and coupled to the two-wire connector 110.

Even though the present disclosure describes a specific shape and structure of the top housing and the bottom housing, one of ordinary skill in the art can understand and appreciate that in other example embodiments, the top housing and the bottom housing can have any other appropriate shape that allows the wire connectors to form a substantially right angle with the housing of the conduit connector without departing from a broader scope of the present disclosure. Further, even though the present disclosure describes the conduit connector as being configured to house a substantially cylindrical conduit, one of ordinary skill in the art can understand and appreciate that in other example embodiments, the mechanical housing assembly, i.e., the top housing and the bottom housing of the conduit connector may be configured to receive and retain a conduit having any other appropriate shape without departing from a broader scope of the present disclosure. For example, the conduit connector may be configured to house a square shaped conduit (square cross-section) with no ribbed/contoured surfaces.

Referring now to FIGS. 2-4, the light fixture part 242 of the connector system may include a locking clip 220 that is coupled to a light module 204 of a light fixture 200 and/or a two-wire connector receptacle 241 that is disposed in the light module 204. In particular, as illustrated in FIGS. 2 and 3, the light module 204 may include an outer housing 291 that has a connector portion 222 and a heat sink portion 232. The term 'light source' as described herein may include any appropriate point or non-point light source without departing from a broader scope of the present disclosure. For example, the light source may include one or more light emitting diodes (LEDs), a halogen lamp, a florescent lamp, etc.

In particular, the connector portion of the outer housing 291 may be raised compared to the heat sink portion 232 such that it can accommodate the two-wire connector receptacle 241 in a vertical or standing up position. Further, the heat sink portion 232 may be configured to dissipate heat generated by a light source (not shown) that is coupled to outer housing 291. In certain example embodiments, the light source may be coupled to the two-wire connector receptacle 241 using one or more electrical wires that are concealed by a wire cover member (not shown) that is coupled to and disposed underneath the outer housing 291. The wire cover member may also be configured to provide support the vertically oriented two-wire connector receptacle 241 in the connector portion 222 of the outer housing 291.

As illustrated in FIGS. 2 and 3, the connector portion 222 of the outer housing 291 may include a top surface 224 (herein interchangeably referred to as 'top surface of the light module') that has an opening 302 that extends through the top surface 224. Said opening 302 on the top surface 224 of the light module 204 may be configured to receive one or more two-wire connector receptacles 241 such that: (a) the top ends of the one or more two-wire connector receptacles 241 are flush with the opening 302, and (b) a body of the one or more two-wire connector receptacles 241 is disposed below the opening and concealed by the outer housing 291 of the light module 204. For example, the opening 302 has two portions 302*a* and 302*b*, where the first portion 302*a* of the opening 302 is configured to receive a first two-wire connector receptacle 241 such that the top end of the first two-wire connector receptacle 241 is flush with the first opening 302*a*, and the second portion 302*b* of the opening 302 is configured to receive a second two-wire connector receptacle 241*a* (shown in FIG. 11) such that the top end of the second two-wire connector receptacle 241*a* is flush with the second opening 302*b*.

In addition to the opening 302, the top surface 224 of the light module 204 may include a through aperture 306 that is disposed on one side of the opening 302 and a through slot 304 disposed on an opposite side of the opening 302. In particular, the through aperture 306 and the through slot 304 may be configured to facilitate the locking clip 220 to be coupled to the top surface 224 of the light module 204. The locking clip 220 may be described in greater detail below in association with FIG. 4.

Referring now to FIG. 4, the locking clip 220 may include a planar base portion 402, a tongue 408, and/or two arms 412*a* and 412*b*. In particular, the planar base portion 402 may include a first lateral edge 450*a*, a second lateral edge 450*b* disposed opposite to the first lateral edge 450*a*, a first longitudinal edge 450*c* extending from one end of the first lateral edge 450*a* to a corresponding end of the second lateral edge 450*b*, and a second longitudinal edge 450*d* extending from an opposite end of the first lateral edge 450*a* to a corresponding opposite end of the second lateral edge 450*b*.

Figure 11:
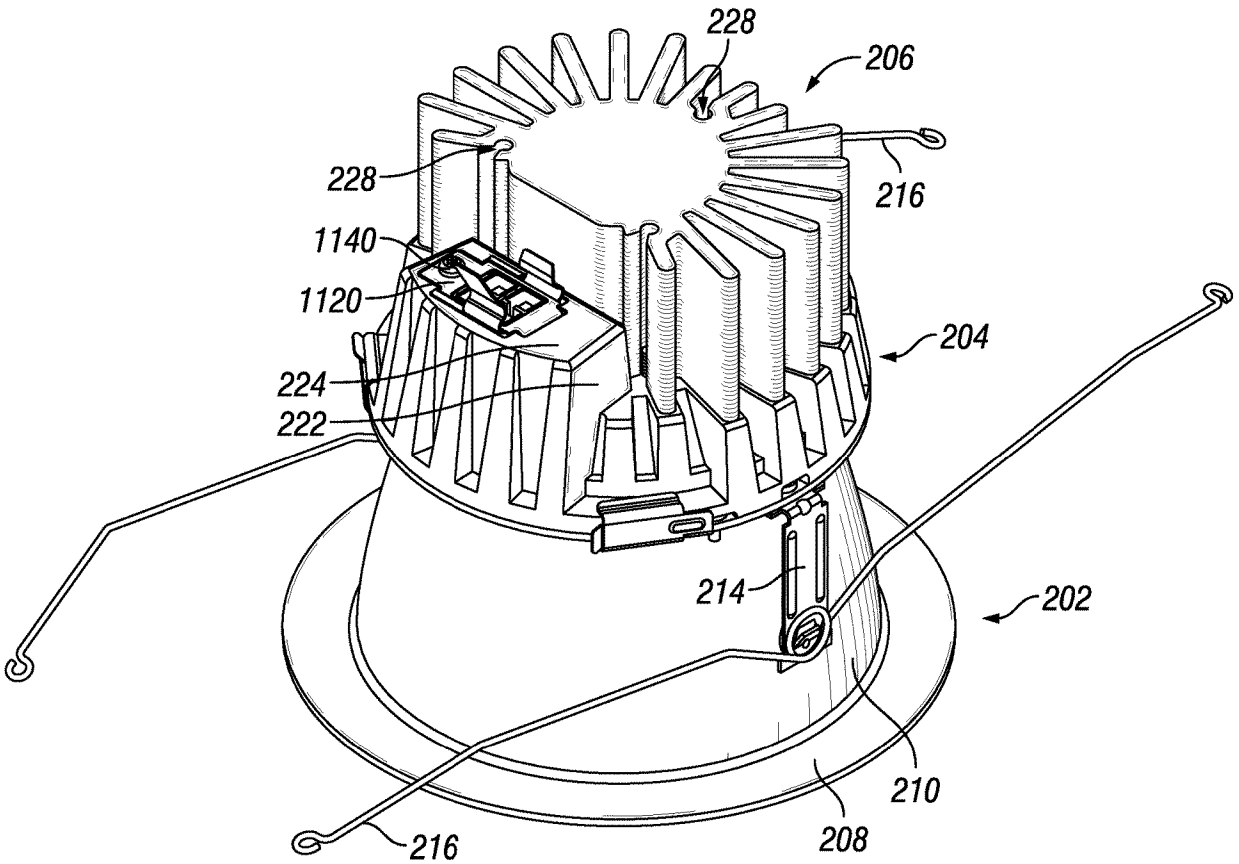
FIG. 11 illustrates a perspective view of an example light fixture that houses a wire connector receptacle and another example locking clip coupled to the example light fixture, in accordance with an example embodiment of the present disclosure.

Further, the planar base portion 402 may include a through aperture 404 located adjacent the first lateral edge 450*a*. Furthermore, the planar base portion 402 may include an opening 406 that extends through the planar base portion 402 and disposed between the two longitudinal edges 450*c* and 450*d*. In particular, the opening 406 on the planar base portion 402 of the locking clip 220 may be configured to expose the top ends of one or more two-wire connector receptacles 241 and/or 241*a* when the locking clip 220 is coupled to the top surface 224 of the light module 204. For example, in one embodiment illustrated in FIGS. 2 and 8, the opening 406 may be shaped and positioned such that it substantially aligns with the first portion of the opening 302*a* on the top surface 224 of the light module 204 such that it exposes the top end of the two-wire connector receptacle 241. Further, in said example embodiment of FIGS. 2 and 8, the second portion of the opening 302*b* may be covered by a segment of the planar base portion 402 between the opening 406 and the through aperture 404. However, in another example embodiment, as illustrated in FIG. 11, the locking clip 1120 may have a larger opening 1206 (shown in FIG. 12) that substantially aligns with the whole opening 302, i.e., both the first and second portions of the opening (302*a*, 302*b*) on the top surface 224 of the light module 204 such that it exposes the top ends of both the two-wire connector receptacles (241, 241*a*). In other words, the shape, size, and position of the opening in the planar base portion 402 of the locking clip 220 may differ based on the number of wire connectors in the connector system. For example, for a two wire connector system, the opening of the locking clip may be shaped and positioned to expose one two-wire connector receptacle (top ends), while in a four-wire connector system, the opening of the locking clip may be shaped and positioned to expose two different two-wire connector receptacles (241, 241*a*) (top ends).

Even though the present disclosure describes a two wire connector system and a four-wire connector system, one of ordinary skill in the art can understand that in other embodiments, a connector system having fewer or more number of wire connectors may be within the broader scope of the present disclosure. For example, in some embodiments, the conduit connector of the connector system may be configured to house six wire connectors, and similarly, the locking clip may be configured to expose six wire connector receptacles in the light module 204.

Still referring to FIG. 4, the locking clip 220 may further include a tongue member 408 that sticks out and downwards from the second lateral edge 450*b* of the locking clip's planar base portion 402. Furthermore, the locking clip 220 may include two arms 412*a* and 412*b* extending upwards (i.e., opposite direction of tongue) from opposite longitudinal edges 450*c* and 450*d* of the locking clip's planar base portion 402, respectively. In particular, the two arms 412*a* and 412*b* may be positioned adjacent the second lateral edge 450*b* of the planar base portion 402. As illustrated in FIG. 4, each arm 412 of the locking clip 220 may include: a bottom portion 414 that extends upwards and inwards in a direction of the planar base portion 402, and a top portion 410 that extends further upwards in a direction away from the planar base portion. In other words, the bottom portions of both the arms 414*a* and 414*b* extend upward and towards each other, while the upper portions of both the arms 410*a* and 410*b* extend further upwards and away from each other.

In certain example embodiments, the arms 412*a* and 412*b* of the locking clip 220 may be flexible such that they push away from each other when pressure is applied on them, and they return back to their default position when the pressure is released. For example, a user can push the two arms away from each other by applying pressure on the upper portion of the two arms with two fingers. However, when the user releases the pressure by removing the two fingers from the upper portion of the two arms, the two arms return to their default state, i.e., they spring back towards each other.

In certain example embodiments, as illustrated in FIGS. 2, 3, and 4, the locking clip 220 may be coupled to the top surface 224 of the light module 204 by: (a) inserting the tongue member 408 of the locking clip 220 into the through slot 304 on the top surface 224; (b) disposing the planar base portion 402 of the locking clip 220 on the top surface 224 such that the through aperture 404 and the opening 406 of the locking clip 220 are axially aligned with the through aperture 306 and at least a portion of the opening 302 of the top surface 224, respectively; and (c) passing a fastener 240 through the axially aligned through apertures (306, 404) of the locking clip 220 and the top surface 224 of the light module 204.

Even though the present disclosure describes a specific mechanism for coupling the locking clip 220 to the light module 204, one of ordinary skill in the art can understand and appreciate that the locking clip 220 can be coupled to any other portion of the light module 204 using any other appropriate coupling mechanism without departing from a broader scope of the present disclosure. Further, even though the present disclosure describes a locking clip as having several portion, one of ordinary skill in the art can understand and appreciate that in other example embodiments, the locking clip can have fewer or more portions without departing from a broader scope of the present disclosure. For example, in some embodiments, the locking clip 220 may not include the tongue member 408. Alternatively, in other embodiments, the locking clip 220 may be replaced by any other device that satisfies the function of the locking clip as described herein, i.e., mate the conduit connector with the light fixture part, securely retain the conduit connector in position when it matingly engages the light module, and/or allow a one-handed and tool-less connect and disconnect of the conduit connector with the light module.

In particular, to connect the conduit connector 100 to the light module 204, first, a user may push the arms 412*a* and 412*b* of the locking clip 220 away from each other. Then, the user may position the mechanical housing assembly 104 of the conduit connector 100 in between the two arms 412*a* and 412*b* of the locking clip 220 such that the bottom portion 703 of the wire connector(s) 110 that projects out from the mechanical housing assembly 104 is above the opening 406 of the locking clip 220 that exposes the top end of the wire connector receptacles 241. Further, the user may push the mechanical housing assembly 104 to insert the bottom portion 703 of the wire connector(s) 110 that projects out from the mechanical housing assembly 104 into the wire connector receptacles 241 of the light module 204. In certain example embodiments, the light module 204 may receive electrical power when the bottom portion 703 of the wire connector(s) 110 is fully inserted into the wire connector receptacles 241. However, in other example embodiments, a partial insertion may be enough for the light module 204 to receive electrical power from the external power source via the conduit connector 100. Once, wire connector(s) 110 of the conduit connector 100 are is inserted into the wire connector receptacles 241 of the light module 204, the user may release a pressure on the arms (412*a*, 412*b*) of the locking clip 220 which causes the arms (412*a*, 412*b*) to spring back towards each other such that they engage the mechanical housing assembly 104 of the conduit connector 110 that is disposed in between the arms (412*a*, 412*b*). In particular, the bottom portion 414 of the two arms (412*a*, 412*b*) engages the flanges 520 on the bottom housing 108 of the conduit connector 110 to securely retain the connection between the conduit connector 110 and the light module part 242.

In certain example embodiments, the user may push the arms (412*a*, 412*b*) of the locking clip 220 away from each other by using the user's fingers. Alternatively, in other example embodiments, the user may push the arms (412*a*, 412*b*) of the locking clip 220 away from each other by pushing on the top portion 410 of the arms (412*a*, 412*b*) using the mechanical housing assembly 104 of the conduit connector 100. As the arms push away, the mechanical housing assembly 104 of the conduit connector 100 may slide downwards till the flanges 520 of the mechanical housing assembly 104 snap into or engage the bottom portion 414 of the arms (412*a*, 412*b*). Either ways, the locking clip 220 allow a single handed and tool-less quick connect and disconnect of the conduit connector 100 with the light module 204.

Even though the present disclosure describes the conduit connector as being connected to the light module using the locking clip, one of ordinary skill in the art can understand and appreciate that in other example embodiments, the locking clip may be optional. That is, in other example embodiments, the conduit connector may be connected to the light module without a locking clip or alternatively, using any other device that functions like the locking clip. In said embodiment without the locking clip, the bottom housing of the conduit connector may or may not include the flanges 520. Further, as described above, the mechanical housing assembly of the conduit connector and the locking clip can be configured to accommodate more than two wire connectors, for example, four wire connectors. The four wire connector system may be described in greater detail below in association with FIGS. 10-15.

Four Wire Connector System

Figure 10A:
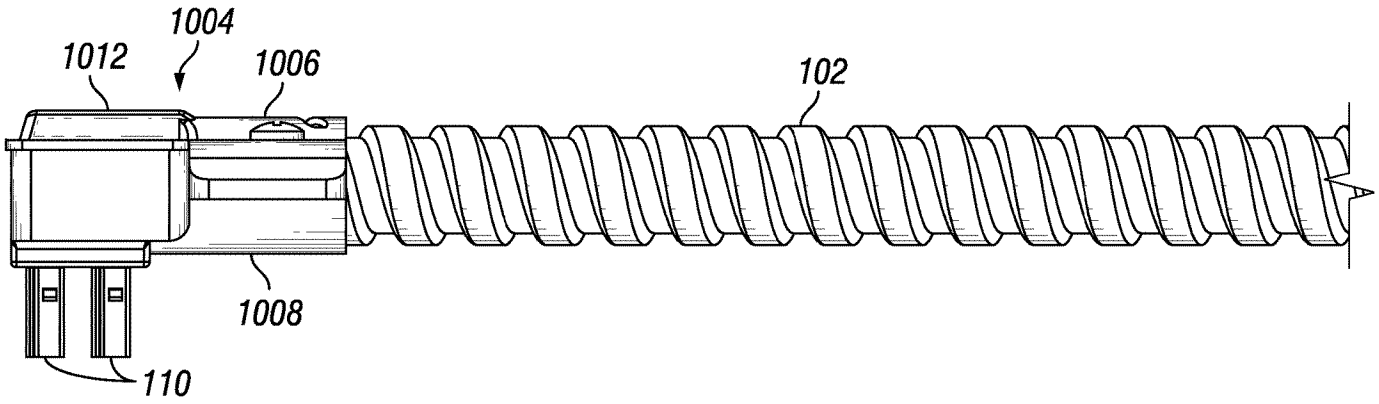
FIGS. 10A and 10B (collectively 'FIG. 10') illustrate a side view and a top view of another example conduit connector, in accordance with an example embodiment of the present disclosure.
Figure 10B:
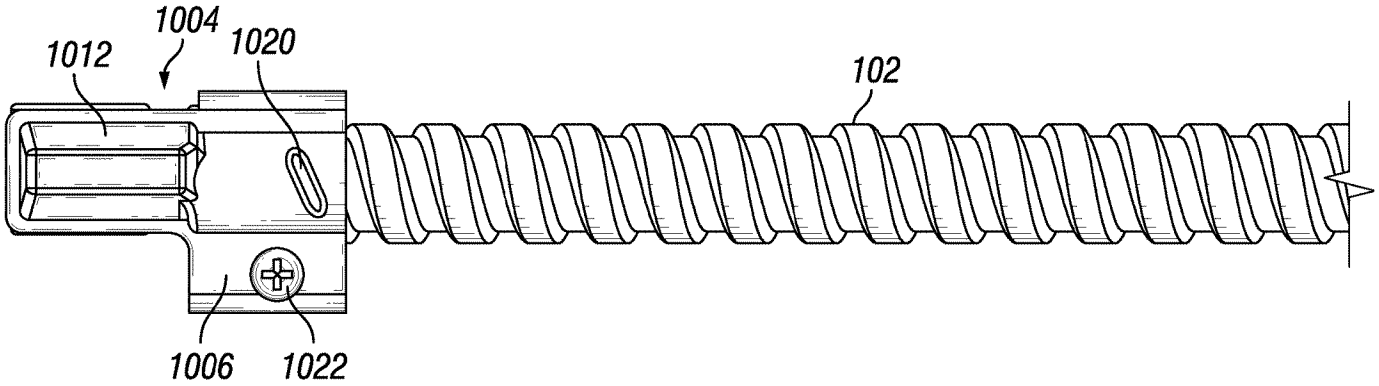
Figure 12:
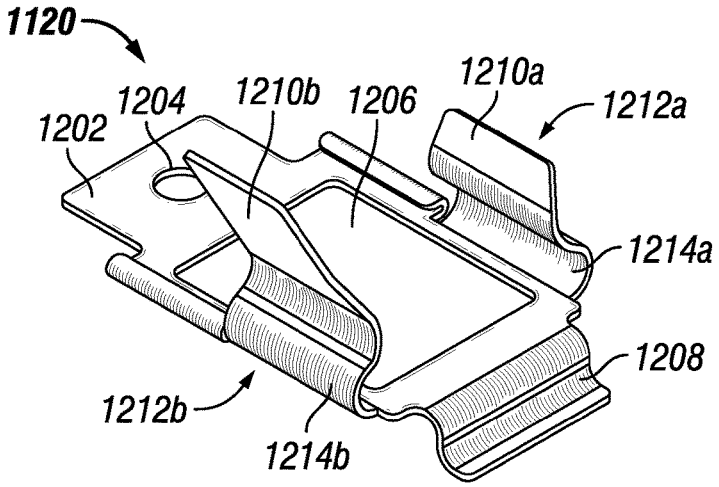
FIG. 12 illustrates the example locking clip of FIG. 11 that allows quick connect and disconnect of the example conduit connector of FIG. 10 to the example light fixture of FIG. 11, in accordance with an example embodiment of the present disclosure.
Figure 13:
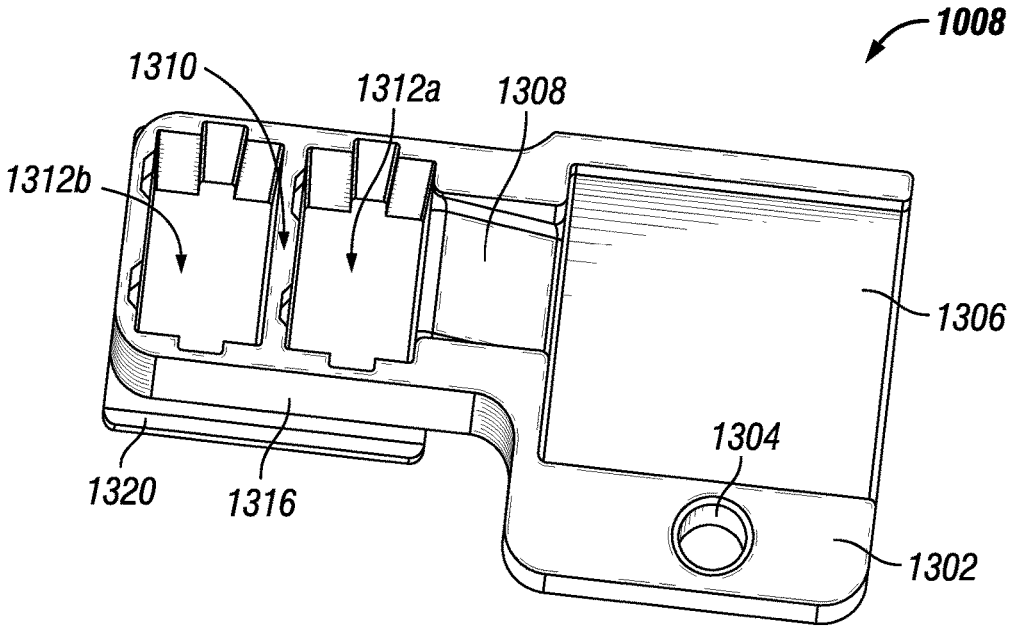
FIG. 13 illustrates perspective view of a bottom housing of the example conduit connector shown in FIG. 10, in accordance with an example embodiment of the present disclosure.
Figure 14A:
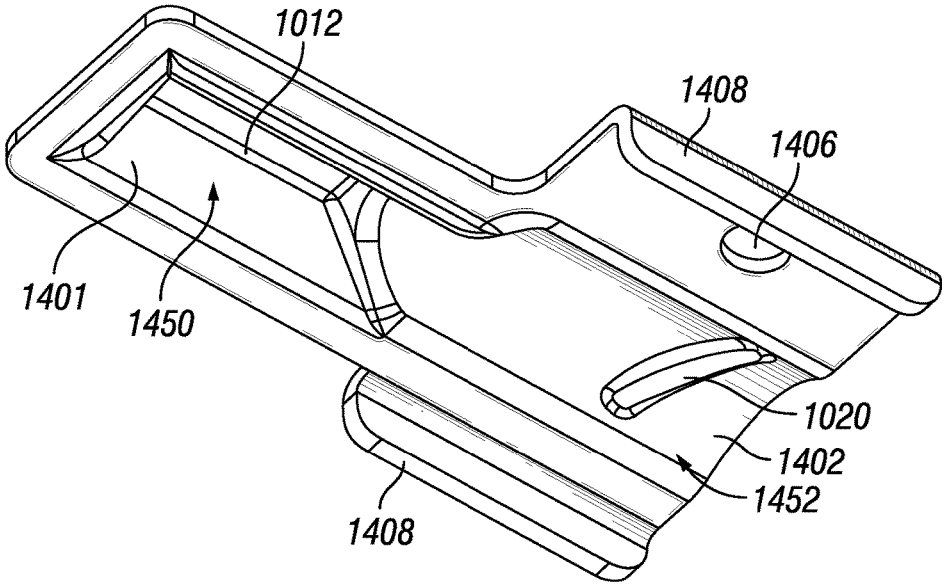
FIGS. 14A and 14B (collectively 'FIG. 14') illustrate a top perspective view and a bottom perspective view of a top housing of the example conduit connector shown in FIG. 10, in accordance with an example embodiment of the present disclosure.
Figure 14B:
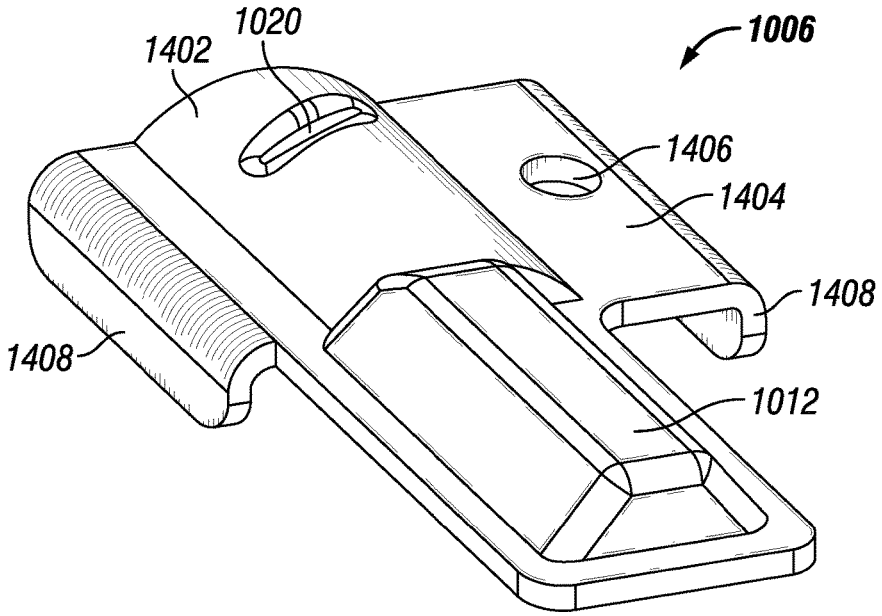
Figure 15:
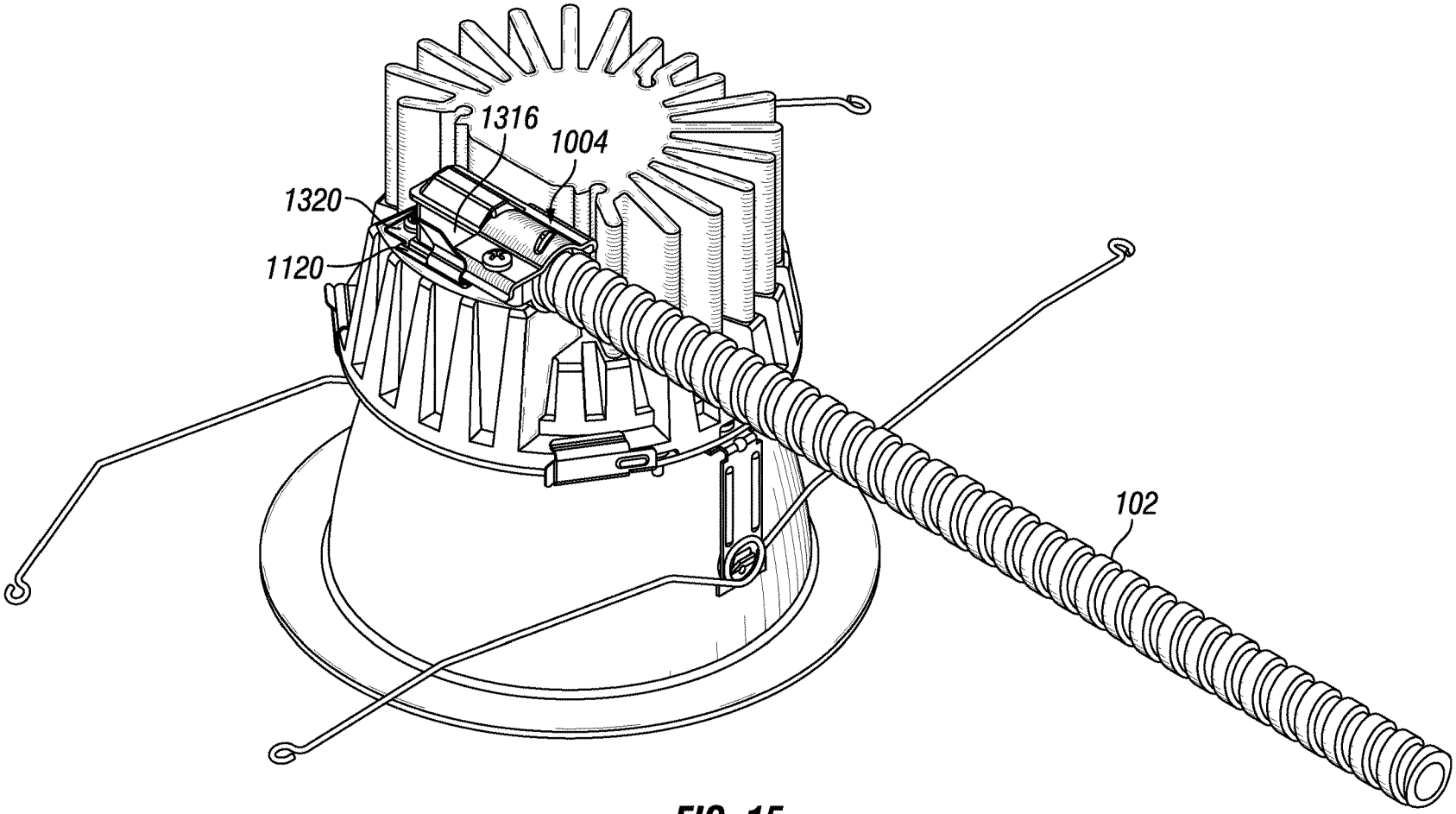
FIG. 15 illustrates the example conduit connector of FIG. 10 connected to the example light fixture of FIG. 11 using the example locking clip of FIG. 11, in accordance with an example embodiment of the present disclosure.

FIGS. 10A and 10B (collectively 'FIG. 10') illustrate a side view and a top view of another example conduit connector, in accordance with an example embodiment of the present disclosure; FIG. 11 illustrates a perspective view of an example light fixture that houses a wire connector receptacle and another example locking clip coupled to the example light fixture, in accordance with an example embodiment of the present disclosure; FIG. 12 illustrates the example locking clip of FIG. 11 that allows quick connect and disconnect of the example conduit connector of FIG. 10 to the example light fixture of FIG. 11, in accordance with an example embodiment of the present disclosure; FIG. 13 illustrates perspective view of a bottom housing of the example conduit connector shown in FIG. 10, in accordance with an example embodiment of the present disclosure; FIGS. 14A and 14B (collectively 'FIG. 14') illustrate a top perspective view and a bottom perspective view of a top housing of the example conduit connector shown in FIG. 10, in accordance with an example embodiment of the present disclosure; and FIG. 15 illustrates the example conduit connector of FIG. 10 connected to the example light fixture of FIG. 11 using the example locking clip of FIG. 11, in accordance with an example embodiment of the present disclosure.

Referring to FIGS. 10-15, the four wire connector system may include a mechanical housing assembly 1004 that has a top housing 1006 and a bottom housing 1008 that is coupled to the top housing 1004. As illustrated in FIG. 13, the bottom housing 1008 may include a conduit receiving portion 1302 that defines a cavity 1306 that is configured to house a bottom portion of the electrical wire carrying conduit 102. Further, the conduit receiving portion 1302 of the bottom housing 1008 may include a through aperture 1304. In addition to the conduit receiving portion 1302, the bottom housing 1008 may include a wire connector portion 1316 that defines two cavities 1312*a* and 1312*b* that are separated by a dividing wall 1310. The two cavities 1312*a* and 1312*b* may be open on a top end and a bottom end. In particular, the two cavities 1312*a* and 1312*b* may be configured to house a pair of two-wire connectors 110 (one two-wire connector shown in FIG. 7), i.e., one two-wire connector 110 in the first cavity 1312*a* and another two-wire connector 110 in the second cavity 1312*b*, thereby, having four wire connectors. Similar to the two wire connector system, the each two-wire connector of the pair of two-wire connectors may be disposed in a vertical orientation within the cavities 1312*a* and 1312*b* of the bottom housing 1008. Further, the wire connectors may form a substantially right angle with the housing 1004 as illustrated in FIG. 10A. The substantially right angle alignment of the wire connectors with respect to the mechanical housing assembly in the four wire connector system may be similar to that of the two wire connector system described above and therefore, will not be repeated for sake of brevity.

Further, the wire connector portion 1316 of the bottom housing 1008 may include two horizontally oriented flanges 1320 that extend out substantially perpendicularly from the side walls of the wire connector portion 1316. Furthermore, the bottom housing 1008 may include a middle portion having a sloped surface 1308 that inclines upward from the conduit receiving portion 1302 towards the wire connector portion 1316. The middle portion having the sloped surface 1308 may be configured to route electrical wires from the conduit 102 to each two-wire connector 110 of the pair of two-wire connectors.

Referring to FIG. 14, the top housing 1006 may include a conduit receiving portion 1402 that defines a cavity 1452 that is configured to house a top portion of the conduit 102. Further, the conduit receiving portion 1402 of the top housing 1006 may include a through aperture 1406. Furthermore, the conduit receiving portion 1402 of the top housing 1006 may include a relief rib 1020 that is configured to bias a ribbed/contoured surface of the conduit 102 to prevent the conduit 102 from being pulled out once the conduit 102 is overlappingly received and retained by the mechanical housing assembly 1004. Additionally, the conduit receiving portion 1402 of the top housing 1006 may include two wing segments 1408 that are bent downwards at their ends. In particular, when the top housing 1006 is placed over the bottom housing 1008, the bent ends of the wing segments 1408 may be configured to fit over an outer surface of conduit receiving portion 1302 of the bottom housing 1008 as illustrated in FIG. 10A.

In addition to the conduit receiving portion 1402, the top housing 1006 may include a wire connector portion 1401 that has a raised top surface 1012. In particular, the raised top surface 1012 of the top housing's wire connector portion 1401 may define a cavity 1450 that is configured to route the electrical wires from the conduit 102 to each two-wire connector of the pair of two-wire connectors 110. The raised top surface 1012 may provide extra space for receiving and bending the wires down towards the two-wire connectors 110.

As illustrated in FIG. 10, the top housing 1006 may be coupled to the bottom housing 1008 using a fastener 1022. In particular, top housing 1006 may be disposed above the bottom housing 1008 such that the wire connector portions (1401, 1316) and the conduit receiving portion (1302, 1402) of the top and bottom housings (1006, 1008) may be aligned. Additionally, the through apertures 1406 and 1304 of the top and bottom housings (1006, 1008) may be aligned. Further, the fastener 1022, e.g., a screw, may be passed through the aligned through apertures 1406 and 1304 of the top and bottom housings (1006, 1008) to couple the top housing 1006 to the bottom housing 1008.

The light module 204 of the four wire connector system may be substantially similar to that of the two wire connector system described above, except for the opening of the locking clip. Accordingly, for sake of brevity, only relevant differences between the locking clips of the four wire connector system and the two wire connector system may be described below. Referring now to FIGS. 11 and 12, the opening 1206 of the locking clip 1120 may be configured to align with the whole opening 302 on the top surface 224 of the light module 204 rather than aligning with just a portion of the opening 302 as in the two wire connector system. Accordingly, in the four wire connector system, when the locking clip 1120 is coupled to the top surface 224 of the light module 204, the opening 1206 of the locking clip 1120 may expose the top ends of both the two-wire connectors receptacles 241 and 241*a* as illustrated in FIG. 11 rather than the top end of just one two-wire connector receptacle as in the two wire connector system illustrated in FIG. 2.

The coupling of the locking clip 1120 to the top surface 224 of the light module 204 may be substantially similar to that in the two wire connector system described above and therefore, will not repeated for sake of brevity. Similarly, the connection and disconnection of the conduit connector with the light module of the four wire connector system may be substantially similar to that of the two wire connector system, and therefore, will not be repeated for sake of brevity.

Referring back to FIGS. 2 and 11, in addition to the light module 204, the light fixture 200 may include a trim assembly 202 that is removably coupled to a bottom side of the light module 204 using one or more coupling clips 218, and an additional heat sink 206 that is optionally and removably coupled to the top side of the light module using one or more fasteners. The trim assembly 202, the light module 204, and the additional heat sink 206 may be described in greater detail in a concurrently filed and commonly owned U.S. Patent Application No. 15/134,258, titled "Light-Emitting Diode Based Recessed Light Fixtures,", the entire contents of which are hereby incorporated herein by reference.

Although the disclosures provides example embodiments, it should be appreciated by those skilled in the art that various modifications are well within the scope of the disclosure. From the foregoing, it will be appreciated that an embodiment of the present disclosure overcomes the limitations of the prior art. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art. Therefore, the scope of the present disclosure is not limited herein.

What is claimed is:

1. The connector system comprising:

a conduit connector that is configured to connect to a light module of a light fixture to provide electrical power to the light module, wherein the conduit connector comprises:

a housing assembly, wherein the housing assembly is configured to receive and retain an end of a conduit at one end of the housing assembly, wherein the conduit carries electrical wires, and one or more wire connectors disposed in the housing assembly at an opposite end of the housing assembly, wherein the one or more wire connectors are configured to be coupled to the electrical wires; and a locking clip that is coupled to the light module and configured to connect the conduit connector to the light module, the locking clip being flexible to securely retain the housing assembly of the conduit connector when the conduit connector is connected to the light module, and wherein the conduit connector is configured to connect to the light module by matingly engaging a portion of the one or more wire connectors that projects out from the housing assembly with respective wire connector receptacles disposed in the light module.

2. The connector system of claim 1, wherein the housing assembly of the conduit connector comprises:

a bottom housing that comprises:

a conduit receiving portion that is configured to overlappingly receive and retain a bottom portion of the conduit, a wire connector portion that defines a cavity that is open at a bottom side, wherein the one or more wire connectors are disposed in the cavity such that they are vertically oriented and the portion of the one or more wire connectors projects out from the housing assembly through the bottom side of the cavity, and a screw boss comprising a blind aperture; and a top housing that comprises:

a conduit receiving portion that is configured to overlappingly receive and retain a top portion of the conduit, a wire connector portion comprising a raised top surface that covers a top side of the cavity defined by the wire connector portion of the bottom housing, and a through aperture.

3. The connector system of claim 2, wherein the conduit receiving portion of the top housing further comprises a relief rib that is configured to bias a ribbed or contoured surface of the conduit to prevent the conduit from being pulled out once the conduit is inserted in the housing assembly.

4. The connector system of claim 1:

wherein the locking clip comprises:

a planar base portion having a pair of longitudinal edges that are opposite to each other, a through opening disposed between the pair of longitudinal edges, and two arms that are disposed opposite to each other and extend upwards from the respective longitudinal edges of the planar base portion.

5. The connector system of claim 4:

wherein each of the two arms comprises:

a bottom portion that is curved and extends upwards and towards the other arm, and a top portion that extends upwards from an edge of the bottom portion that is away from the planar base portion, and wherein the top portion extends away from the other arm.

6. The connector system of claim 5, wherein the bottom portion of the two arms engages a pair of flanges on the bottom housing of the conduit connector to connect the conduit connector to the light module.

7. The connector system of claim 4, wherein the locking clip is disposed on and coupled to a top surface of the light module such that it exposes a top end of the one or more wire connector receptacles.

8. The connector system of claim 1, wherein the one or more wire connectors include at least two wire connectors.

9. A conduit connector, comprising:

a housing assembly, wherein the housing assembly is configured to receive and retain an end of a conduit at one end of the housing assembly, wherein the conduit carries electrical wires, and one or more wire connectors disposed in the housing assembly at an opposite end of the housing assembly such that at least a portion of the one or more wire connectors projects out from the housing assembly and forms a substantially right angle with the housing assembly, wherein the one or more wire connectors are configured to be coupled to the electrical wires, wherein the conduit connector is configured to connect to a light module of a light fixture to provide electrical power to the light module, and wherein the housing assembly comprises:

a bottom housing that houses the one or more wire connectors; and a top housing that is coupled to the bottom housing and comprises:

a conduit receiving portion that is configured to overlappingly receive and retain a top portion of the conduit, and a wire connector portion comprising a raised top surface, the raised top surface disposed above and configured to cover a top side of a cavity defined by a wire connector portion of the bottom housing.

10. The conduit connector of claim 9, wherein the bottom housing comprises:

a conduit receiving portion that is configured to overlappingly receive and retain a bottom portion of the conduit; and the wire connector portion defines a cavity that is open at a bottom side;

wherein the one or more wire connectors are disposed in the cavity such that they are vertically oriented, and wherein the portion of the one or more wire connectors projects out from the housing assembly through the bottom side of the cavity.

11. The conduit connector of claim 9, wherein the conduit receiving portion of the top housing further comprises a relief rib that is configured to bias a ribbed or contoured surface of the conduit to prevent the conduit from being pulled out once the conduit is inserted in the housing assembly.

12. The conduit connector of claim 9, wherein the one or more wire connectors include two wire connectors.

13. The conduit connector of claim 9, wherein the one or more wire connectors include four wire connectors.

14. A connector system, comprising:

a conduit connector that is configured to connect a conduit to a light module of a light fixture, wherein the conduit connector comprises:

a housing assembly that comprises a top housing and a bottom housing that is coupled to the top housing using one or more fasteners, wherein each of the top housing and the bottom housing comprises:

a conduit receiving portion that is configured to receive and retain a portion of the conduit, and a wire connector portion that is configured to house one or more wire connectors in vertical orientation such that a portion of the one or more wire connectors projects out from the housing assembly and forms a substantially right angle with at least one of the housing assembly and the conduit; and a locking device that is disposed on a top surface of the light module and configured to connect the conduit connector to the light module.

15. The connector system of claim 14, wherein the conduit receiving portion of the top housing is configured to receive and retain a top portion of the conduit, and wherein the conduit receiving portion of the bottom housing is configured to receive a bottom portion of the conduit.

16. The connector system of claim 14, wherein the conduit receiving portion of the top housing comprises a relief rib that is configured to bias a ribbed or contoured surface of the conduit to prevent the conduit from being pulled out once the conduit is inserted in the housing assembly.

17. The connector system of claim 14, wherein the one or more wire connectors include at least two wire connectors.

18. The connector system of claim 14, wherein the light module comprises one or more wire connector receptacles that are configured to matingly engage the portion of the one or more wire connectors that project out from the housing assembly of the conduit connector.

* * * * *